US006068454A

United States Patent [19]

Gaston et al.

[11] Patent Number: 6,068,454

[45] Date of Patent: May 30, 2000

[54] FUEL PUMP WITH HELICAL IMPELLER

[75] Inventors: Robert Duane Gaston, Dearborn Heights; Beverly Jane Wozniak, Livonia; Dequan Yu, Ann Arbor, all of Mich.

[73] Assignee: Ford Motor Company, Dearborn, Mich.

[21] Appl. No.: 09/055,427

[22] Filed: Apr. 6, 1998

[51] Int. Cl.[7] ..... F04B 17/00

[52] U.S. Cl. ..... 417/356; 417/423.7; 417/177; 417/241 A

[58] Field of Search ..... 417/356, 423.3, 417/423.7, 424.1; 415/72; 416/126, 127, 241 A, 235, 237, 244 R, 204 R

[56] References Cited

U.S. PATENT DOCUMENTS

| | | | |
|---|---|---|---|
| 1,762,708 | 6/1930 | Allred . | |
| 2,195,902 | 4/1940 | Pezzillo | 417/356 |
| 2,225,338 | 12/1940 | Geiss . | |
| 3,236,221 | 2/1966 | Lear . | |
| 3,565,548 | 2/1971 | Fowler et al. | 416/235 |
| 4,876,492 | 10/1989 | Lester et al. | 417/356 |
| 4,998,865 | 3/1991 | Nakanishi et al. . | |
| 5,088,899 | 2/1992 | Blecker et al. | 417/356 |
| 5,145,329 | 9/1992 | Zumbusch et al. . | |
| 5,324,177 | 6/1994 | Golding et al. . | |
| 5,487,650 | 1/1996 | Gaston et al. | 417/423.6 |
| 5,505,594 | 4/1996 | Sheehan . | |

FOREIGN PATENT DOCUMENTS

| | | |
|---|---|---|
| 0452538 A1 | 10/1991 | European Pat. Off. . |
| 1781462 A1 | 12/1992 | Russian Federation . |

*Primary Examiner*—Charles G. Freay
*Attorney, Agent, or Firm*—Mark S. Sparshu

[57] ABSTRACT

A fuel pump is used for supplying fuel from a fuel tank to an automotive engine. The fuel pump includes a pump housing having an inlet end for receiving fuel from the fuel tank. A brushless DC motor is positioned within the pump housing and includes a rotatable rotor having magnets therein and a central aperture formed through the rotor. A plastic helical-shaped impeller is positioned within the central aperture for rotation with the rotor about a central axis for pumping fuel through the housing to the engine. The impeller has a plurality of vane blades with blade tips secured to the rotor to prevent tip losses. Each vane blade has a leading edge configured to generate laminar fluid flow and reduce vapor generation at the inlet end of the impeller.

11 Claims, 4 Drawing Sheets

FUEL PUMP WITH HELICAL IMPELLER

TECHNICAL FIELD

The present invention relates to a fuel pump and, more particularly, to a fuel pump having a brushless DC motor with an integrated helical impeller.

BACKGROUND OF THE INVENTION

In the early 1990s, ethanol and methanol blends of alcohol gasoline were developed to reduce the amount of hydrocarbons spilled into the air from incomplete combustion during burning of gasoline in automobiles and light trucks. These fuels were found to be corrosive to certain iron, copper, silver, and aluminum bearing alloys contained in fuel pumps which were positioned within the fuel tank. As a result of this corrosive action, automotive engineers have shifted to the use of plastics, carbons, and polymers for fuel pump components due to their resistance to corrosion from alcohol fuels.

More recently, there is a movement toward placing electric in-tank fuel pumps in the fuel tank for transport of diesel fuel to the engine rather than using vacuum created by an engine driven fuel pump. During the development of the initial in-tank or in-line fuel pumps, it was discovered that diesel fuel was corrosive to DC carbon brushes and experimentation has led to the use of special carbon-laden brushes and carbon-covered commutations.

Vehicle design trends toward lower profile overall body designs have resulted in very shallow fuel tanks. This design requirement causes difficulty in packaging of existing fuel pumps in shallow tanks. Current fuel pumps typically have a 38 millimeter diameter and are 110 to 120 millimeters in axial length. Accordingly, difficulties arise in packaging such a long pump in a fuel tank which may only be 120 millimeters deep.

Other design factors leading to the development of the present invention include: 1) the cost of machined aluminum pump chamber bodies and covers; 2) the cost of carbon-covered commutators and longer life carbon alloy brushes; 3) the use of round commutators versus flat, placing the brushes perpendicular to the pump axis to reduce pump axial length; and 4) increased pump-motor diameter to increase motor efficiency and lower system current, while reducing pump axial length.

Accordingly, it is desirable to provide an in-tank or in-line fuel pump with substantially reduced axial length which takes in consideration the above-referenced design factors.

DISCLOSURE OF THE INVENTION

The present invention overcomes the above-referenced shortcomings of prior art in-tank or in-line fuel pumps by providing an in-tank or in-line fuel pump having a brushless DC motor including a rotatable rotor having a plastic helical-shaped impeller positioned within the rotor for pumping fuel from the fuel tank to an automotive engine. By positioning the impeller within the DC motor, the axial length of the impeller is reduced by approximately 67% for use in low profile fuel tanks. By using a helical impeller embedded within the motor rotor, blade tip losses are eliminated. The design also provides corrosive fuel compatible materials.

More specifically, the present invention provides a fuel pump for supplying fuel from a fuel tank to an automotive engine, including a pump housing having an inlet end for receiving fuel from the fuel tank. A brushless DC motor is positioned within the pump housing and includes a rotatable rotor having magnets therein and a central aperture formed through the rotor. A plastic helical-shaped impeller is positioned within the central aperture for rotation with the rotor about a central axis for pumping fuel through the housing to the engine. The impeller includes a plurality of vane blades with blade tips secured to the rotor to eliminate blade tip losses.

In a preferred embodiment, each vane blade has a leading edge formed at an inlet end of the impeller. Each leading edge has a flat portion formed perpendicular to the central axis of the impeller, and a curved nose portion extending from the flat portion for generating laminar fluid flow and reducing vapor generation at the inlet end of the impeller.

Preferably, the impeller has an integrally molded cap at an outlet end of the impeller which is engaged against the rotor to prevent axial movement of the impeller through the rotor as a result of forces generated by pressurized fuel at the outlet end.

Accordingly, an object of the present invention is to provide a fuel pump having a substantially reduced axial length without loss of pump efficiency for in-tank or in-line use.

Another object of the invention is to provide a fuel pump having an impeller with a leading edge with a flat portion perpendicular to the central axis of the impeller and a curved nose portion extending from the flat portion for generating laminar fluid flow.

The above objects and other objects, features and advantages of the present invention are readily apparent from the following detailed description of the best mode for carrying out the invention when taken in connection with the accompanying drawings.

DETAILED DESCRIPTION OF THE PREFERRED EMBODIMENT

Figure 2:
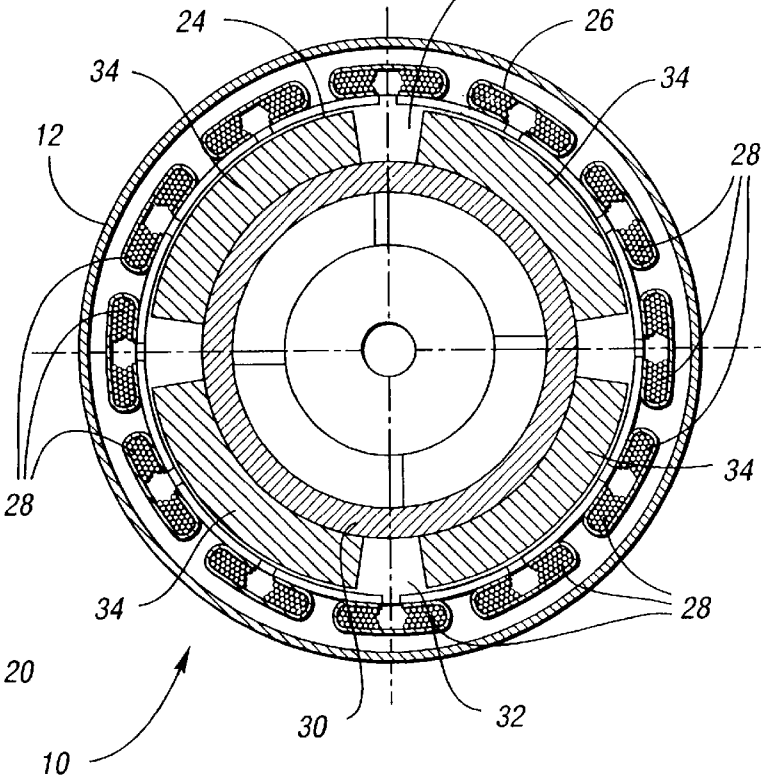
FIG. 2 shows a vertical cross-sectional view of the fuel pump of FIG. 1 taken at line 2—2.
Figure 1:
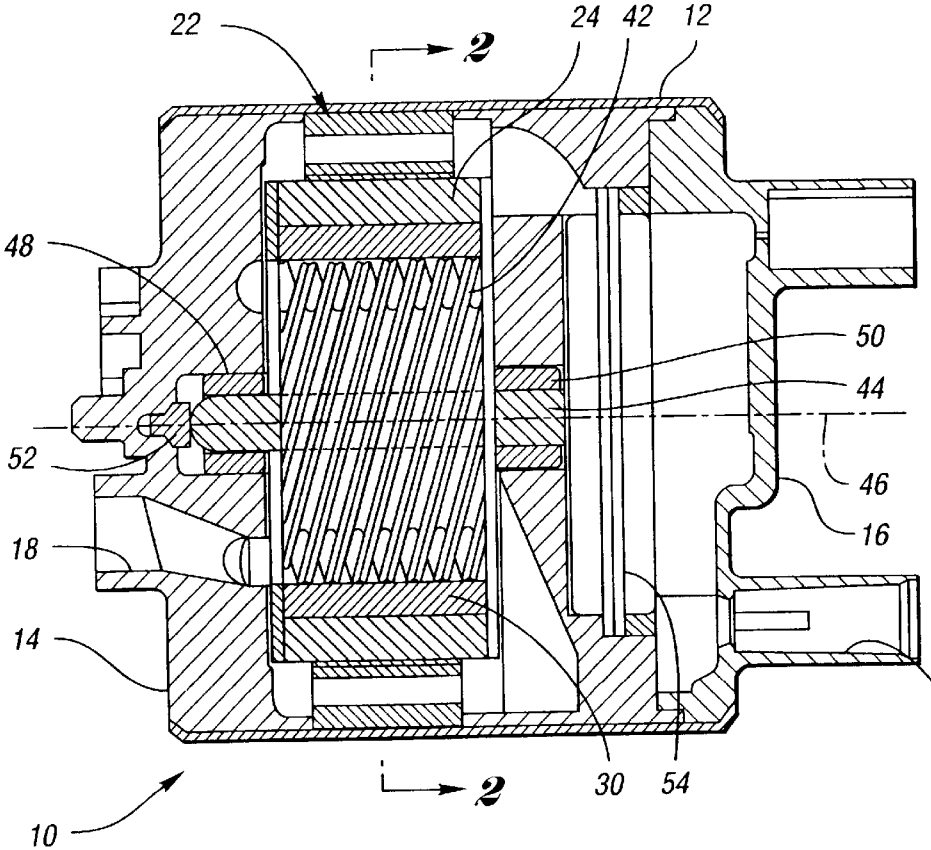
FIG. 1 shows a longitudinal cross-sectional view of a fuel pump in accordance with the present invention.

Referring to FIGS. 1 and 2, a fuel pump 10 is shown for supplying fuel from a fuel tank to an automotive engine. The fuel pump 10 includes a steel pump housing 12 having an inlet cover 14 and an outlet cover 16 at opposing ends of the housing 12. The inlet cover 14 has an inlet opening 18 for receiving fuel from the lowest part of the fuel tank, and the outlet cover 16 includes a fuel outlet opening 20 for directing fuel to the vehicle engine.

A brushless DC motor 22 is positioned within the pump housing 12 and includes a rotatable rotor 24 which is rotatable within the stator 26, which is a series of stacked laminations. The stator 26 includes three sets of windings 28 wrapped in 12 slots around the periphery of the laminations. Preferably, a 0.64 mm air gap is provided between the stator 26 and the rotor 24. The rotor 24 includes an iron core 30 with a plastic filler 32 and a plurality of magnets 34, 36, 38, 40 therearound. The magnets are operative to boost the flux across the air gap.

A plastic helical-shaped impeller 42 is positioned within the iron core 30 for rotation with the rotor 24. The impeller 42 is rotatable on a central shaft 44 about a central axis 46. Bearings 48,50 are provided at opposing ends of the central shaft 44, and a thrust button 52 abuts the shaft 44 to maintain the position of the shaft 44. With the impeller 42 embedded in the rotor 24, blade tip losses are eliminated at the ends of the vane blades of the impeller 42.

Preferably, the impeller 42, as well as the inlet cover 14 and outlet cover 16, comprises a plastic material, such as acetyl or phenolic, to avoid corrosion.

The rotating impeller 42 draws fuel in through the inlet opening 18 into the four-bladed impeller 42, through the impeller 42, around the periphery of the electronics module 54, and through the outlet opening 20 to the engine. The electronics module 54 may be round or square, as a matter of design choice.

Figure 3:
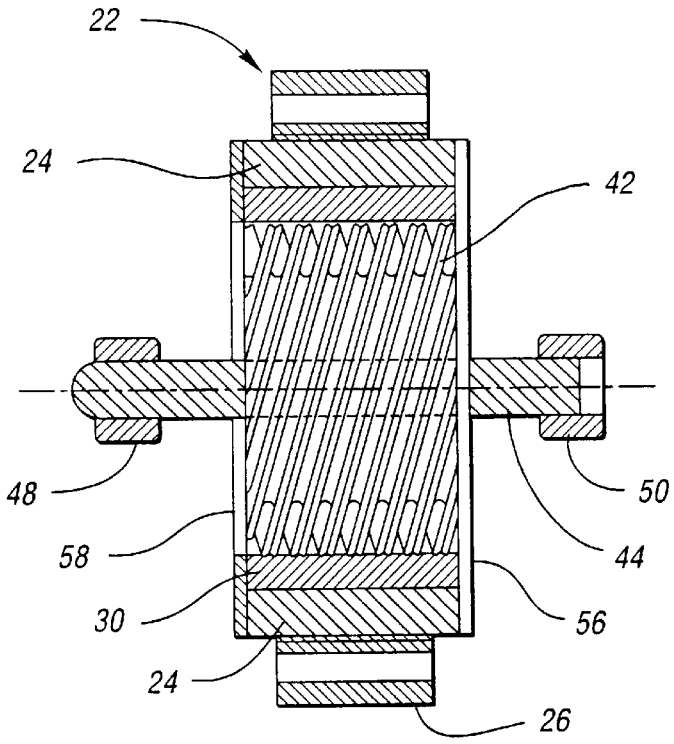
FIG. 3 shows a cross-sectional view of a DC brushless motor and impeller in accordance with the embodiment of FIG. 1.
Figure 4:
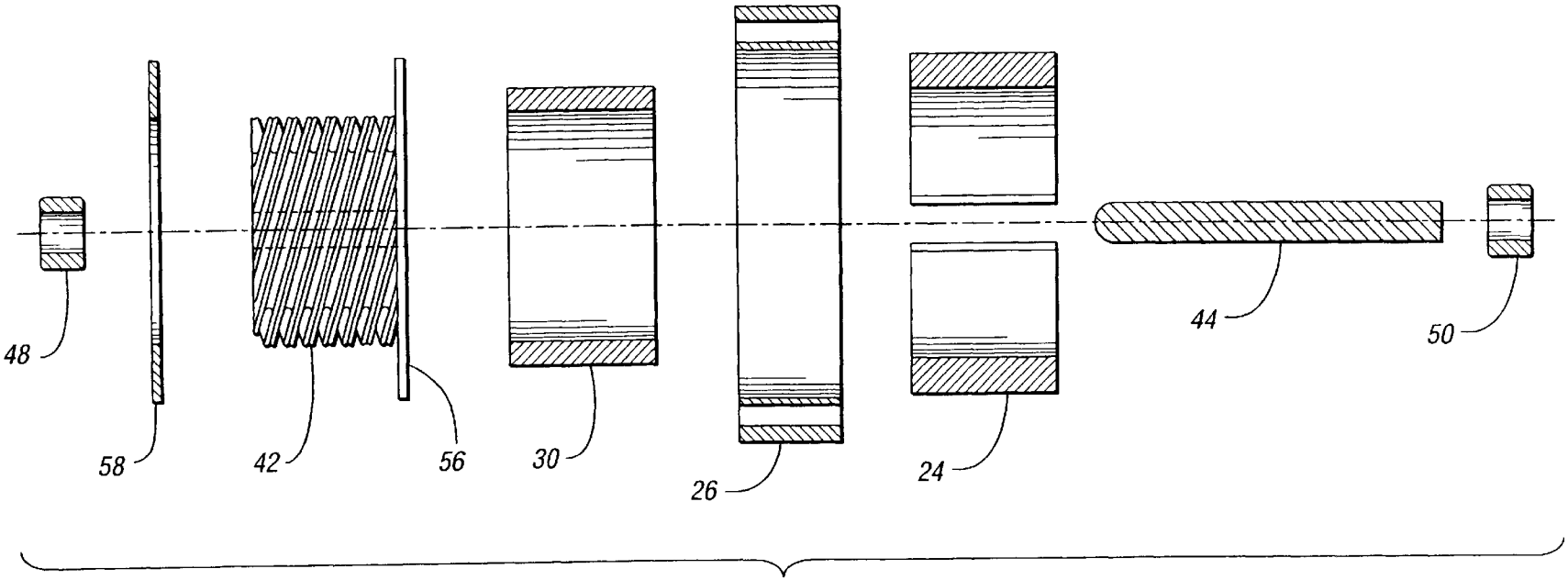
FIG. 4 shows an exploded cross-sectional side view of a DC brushless motor and impeller in accordance with the embodiment of FIG. 1.

The brushless DC motor 22 is more clearly shown in FIGS. 3 and 4. As shown, the impeller 42 has an integrally molded end cap 56 at the outlet end, and an adhered end cap 58 at the inlet end. The integrally molded end cap 56 bears against the rotor 24 to prevent movement of the impeller through the rotor 24 as a result of fuel pressure generated at the outlet end of the impeller 42.

Figure 6:
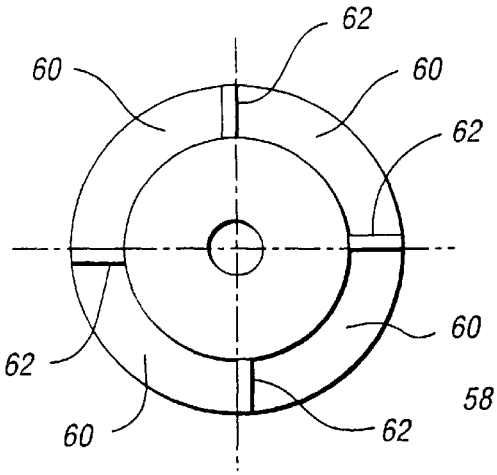
FIG. 6 shows an end view of the inlet end of the impeller of FIG. 6.
Figure 5:
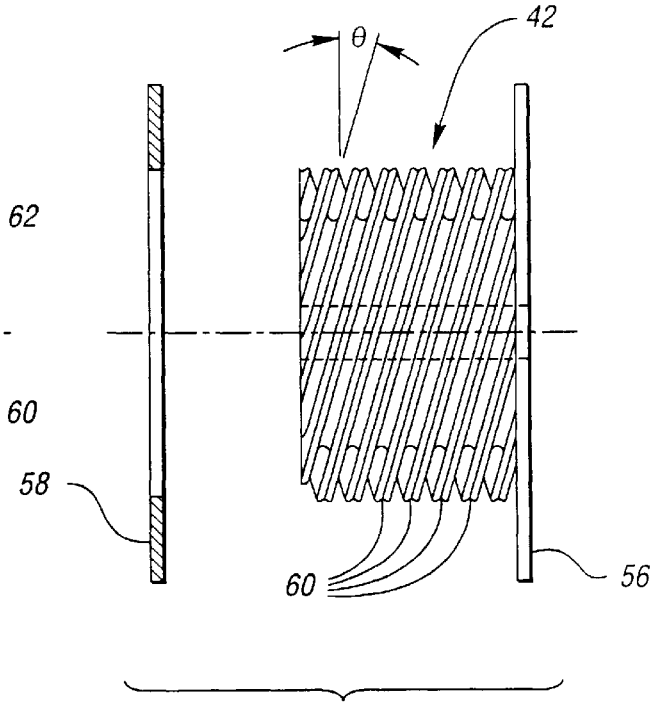
FIG. 5 shows an exploded side view of an impeller in accordance with the embodiment of FIG. 1.

As shown in FIG. 5, the vane blades 60 of the impeller 42 have an angle θ of approximately 16°, but may range from approximately 14° to 16°. The end view of FIG. 6 illustrates the fact that the impeller 42 has four equally spaced helical vane blades 60, each having a leading edge 62.

Figure 8:
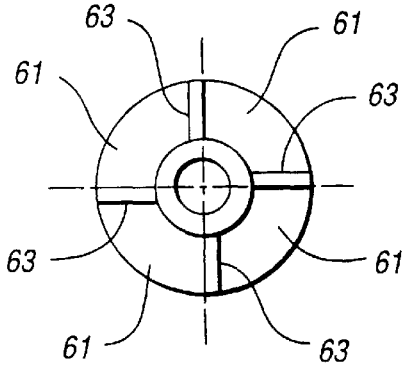
FIG. 8 shows an end view of the inlet end of the impeller of FIG. 8.
Figure 7:
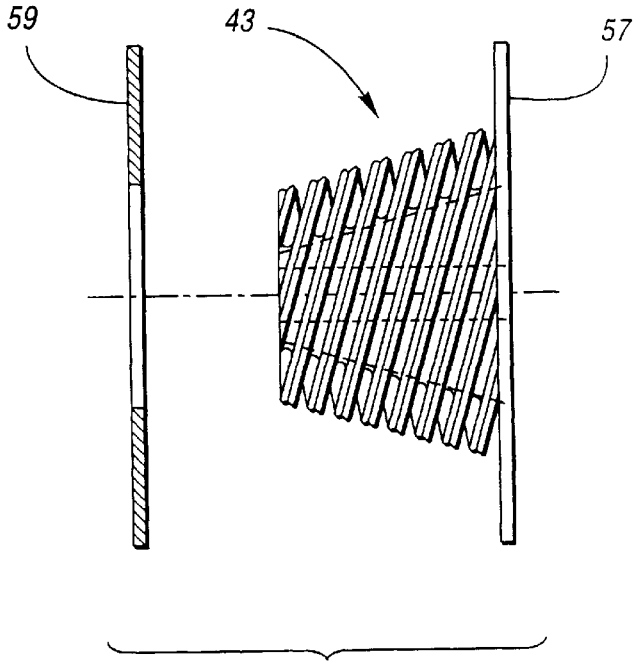
FIG. 7 shows an exploded side view of an impeller in accordance with an alternative embodiment of the invention.

Referring to FIGS. 7 and 8, an alternative impeller 43 is shown. The impeller 43 has a conical peripheral shape, and includes an integrally molded end cap 57 and an adhered end cap 59. The peripheral shape of the impeller 43 is a matter of design choice and may be used to optimize pump efficiency. As shown in FIG. 8, the impeller 43 comprises four vane blades 61 with leading edges 63.

Figure 9:
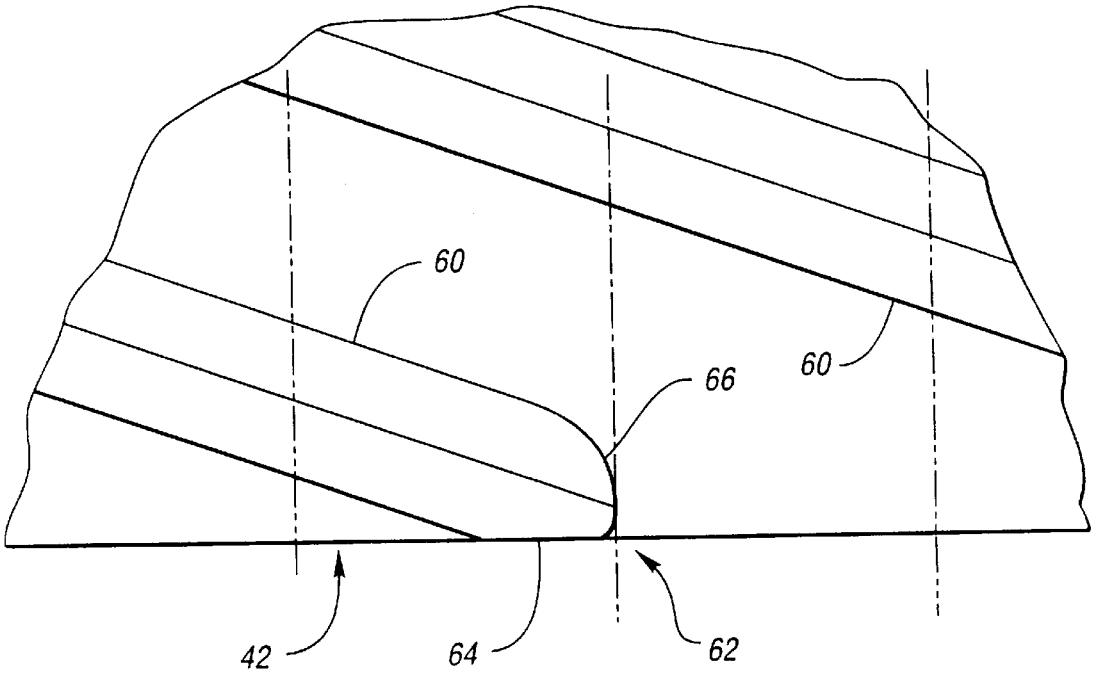
FIG. 9 shows an enlarged side view of the inlet end of the impeller of FIG. 6.

As shown in FIG. 9, each leading edge 62 comprises a flat portion 64 formed perpendicular to the central axis 46 and a curved nose portion 66 extending from the flat portion 64 for generating laminar fluid flow and reducing vapor generation at the inlet of the impeller 42 by avoiding sudden increase of pressure to prevent inlet cavitation. The flat portion 64 is machined to assure true flatness of the impeller and rotor at the inlet. The depth of the inlet opening 18 may vary to produce more efficient flow characteristics. Fuel from the helical impeller 42 is used to cool the electronic commutation module and is circulated past the outer motor core for cooling purposes. The electronic module carrier 54 may be used as a termination component and as a fuel direction diffuser to gain an increment of pressure.

By increasing the outside diameter of the pump to 50–55 mm, the present invention improves pump efficiency, allows incorporation of the impeller 42 within the rotor 24 to provide a substantially reduced axial length (preferably 58 to 62 mm in axial length), and as pressure demands increase, the motor and impeller 42 may be lengthened and still be practical for use in lower profile fuel tanks. The brushless motor is very useful in corrosive fuel environments, such as diesel and high-alcohol content fuels.

While the best mode for carrying out the invention has been described in detail, those familiar with the art to which this invention relates will recognize various alternative designs and embodiments for practicing the invention within the scope of the appended claims.

What is claimed is:

1. A fuel pump for supplying fuel from a fuel tank to an automotive engine, the fuel pump comprising:

a pump housing having an inlet end for receiving fuel from the fuel tank;

a brushless DC motor positioned within the pump housing and including a rotatable rotor having magnets therein and a central aperture formed through the rotor;

a plastic helical-shaped impeller positioned within said central aperture for rotation with the rotor about a central axis for pumping fuel through the housing to the engine, said impeller having a plurality of vane blades with blade tips secured to the rotor: and wherein said impeller comprises an integrally molded cap at an outlet end of the impeller for engagement against the rotor to prevent axial movement of the impeller through the rotor as a result of forces generated by pressurized fuel at said outlet end.

2. The fuel pump of claim 1, wherein each said vane blade comprises a leading edge formed at an inlet end of the impeller, each said leading edge comprising a flat portion formed perpendicular to said central axis, and a curved nose portion extending from said flat portion for generating laminar fluid flow and reducing vapor generation at the inlet end of the impeller.

3. The fuel pump of claim 1, wherein each said vane blade comprises an inclination angle of approximately 14° to 18° with respect to a plane perpendicular to said central axis.

4. The fuel pump of claim 1, further comprising an adhered cap secured to the inlet end of the impeller for engagement against the rotor.

5. The fuel pump of claim 1, wherein said plurality of vane blades comprises four vane blades spaced equally about the impeller.

6. A fuel pump for supplying fuel from a fuel tank to an automotive engine, the fuel pump comprising:

a pump housing having an inlet end for receiving fuel from the fuel tank;

a brushless DC motor positioned within the pump housing and including a rotatable rotor having magnets therein and a central aperture formed through the rotor;

a plastic helical-shaped impeller positioned within said central aperture for rotation with the impeller along a central axis for pumping fuel through the housing to the engine, said rotor having a plurality of vane blades with blade tips secured to the rotor; and wherein each said vane blade comprises a leading edge formed at an inlet end of the impeller, each said leading edge comprising a flat portion formed perpendicular to said central axis, and a curved nose portion extending from said flat portion for generating laminar fluid flow and reducing vapor generation at the inlet end of the impeller.

7. The fuel pump of claim 6, wherein each said vane blade comprises an inclination angle of approximately 14° to 18° with respect to a plane perpendicular to said central axis.

8. The fuel pump of claim 6, wherein said impeller comprises an integrally molded cap at an outlet end of the impeller for engagement against the rotor to prevent axial movement of the impeller through the rotor as a result of forces generated by pressurized fuel at said outlet end.

9. The fuel pump of claim 8, further comprising an adhered cap secured to the inlet end of the impeller for engagement against the rotor.

10. The fuel pump of claim 6, wherein said plurality of vane blades comprises four vane blades spaced equally about the impeller.

11. A fuel pump for supplying fuel from a fuel tank to an automotive engine, the fuel pump comprising:

a pump housing having an inlet end for receiving fuel from the fuel tank;

a brushless DC motor positioned within the pump housing and including a rotatable rotor having magnets therein and a central aperture formed through the rotor;

a plastic helical-shaped impeller positioned within said central aperture for rotation with the rotor about a central axis for pumping fuel through the housing to the engine, said impeller having a plurality of vane blades with blade tips secured to the rotor; and wherein said impeller comprises an integrally molded cap at an outlet end of the impeller for engagement against the rotor to prevent axial movement of the impeller through the rotor as a result of forces generated by pressurized fuel at said outlet end.

* * * * *